US005351358A

United States Patent [19]

Larrimore

[11] Patent Number: 5,351,358

[45] Date of Patent: Oct. 4, 1994

[54] TOOTHBRUSH

[76] Inventor: BaBaTu Larrimore, 140 Royal Palm Ct., Plantation, Fla. 33317

[21] Appl. No.: 936,851

[22] Filed: Aug. 27, 1992

[51] Int. Cl.[5] ..... A46B 7/02; A46B 9/04

[52] U.S. Cl. ..... 15/201; 15/143.1; 15/167.2

[58] Field of Search ..... 15/167.2, 167.1, 144.1, 15/143.1, 201, 207.2

[56] References Cited

U.S. PATENT DOCUMENTS

| | | | |
|---|---|---|---|
| 569,870 | 10/1896 | Hamilton | 15/167.2 |
| 1,353,780 | 9/1920 | Mueller | 15/167.2 |
| 1,908,509 | 5/1933 | Davis | 15/167.2 |
| 1,928,328 | 9/1933 | Carpentier | 15/167.1 |
| 2,254,365 | 9/1941 | Griffith et al. | 15/167.1 |
| 2,263,360 | 11/1941 | Karshmer | 15/167.2 |
| 2,443,297 | 6/1948 | Bressler | 15/167.1 |
| 2,633,591 | 4/1953 | Servilla | 15/143.1 |
| 2,650,383 | 9/1953 | Bressler | 15/167.1 |
| 3,065,479 | 11/1962 | McGee | 15/167.2 |
| 3,067,446 | 12/1962 | McGauley | 15/167.1 |
| 3,188,672 | 6/1965 | Gary | 15/201 |
| 3,253,292 | 5/1966 | Herschensohn | 15/201 |
| 4,137,593 | 2/1979 | Porper | 15/167.2 |
| 4,757,570 | 7/1988 | Haeusser et al. | 15/144.1 |

FOREIGN PATENT DOCUMENTS

| | | | |
|---|---|---|---|
| 659784 | 2/1965 | Belgium | 15/167.2 |
| 387388 | 7/1908 | France | 15/167.2 |
| 707843 | 7/1931 | France | 15/167.2 |
| 1162537 | 9/1958 | France | 15/167.2 |
| 508200 | 2/1956 | Italy | 15/167.2 |
| 546893 | 6/1957 | Italy | 15/167.2 |
| 4915 | of 1897 | United Kingdom | 15/167.2 |
| 366382 | 2/1932 | United Kingdom | 15/167.2 |
| 2169499 | 7/1986 | United Kingdom | 15/167.2 |
| 9006701 | 6/1990 | World Int. Prop. O. | 15/167.2 |

*Primary Examiner*—Timothy F. Simone
*Assistant Examiner*—Tony G. Soohoo
*Attorney, Agent, or Firm*—Malin, Haley, DiMaggio & Crosby

[57] ABSTRACT

A toothbrush for simultaneously brushing the top and side faces of the user's teeth, comprising: first and second orthogonally disposed brush heads unitarily formed with an elongated body portion at one end thereof, the brush heads each comprising a plurality of flexibly adjoined segmented portions, each having a plurality of bristles rigidly attached thereto; and an elongated body having a unitarily formed grip handle at the opposite end thereof and integral provisions for allowing longitudinal twisting and flexing thereof to adjustably conform the toothbrush to the user's bite, the handle having external dimensions and peripheral surface undulations to facilitate comfortable grasping by the user to permit a high degree of control and maneuverability during the tooth cleansing process.

5 Claims, 1 Drawing Sheet

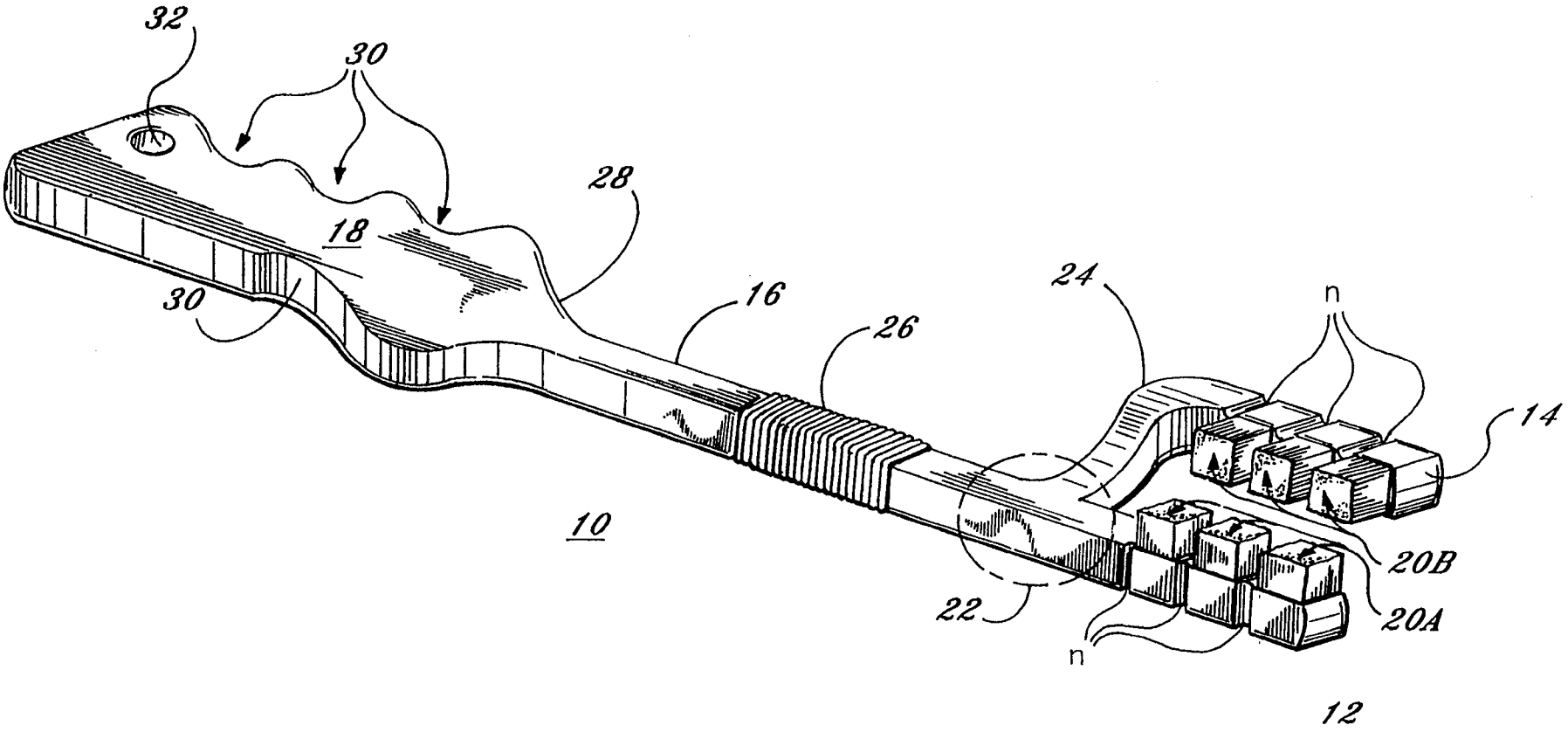
14
20B
20A
12
n
n
24
22
26
16
28
10
30
18
30
32

TOOTHBRUSH

BACKGROUND OF THE INVENTION

1. Field of the Invention

The present invention relates generally to toothbrushes, and more particularly, to an improved toothbrush capable of cleansing two faces of the user's teeth simultaneously, and containing a high degree of adjustability to conform to the user's bite for ease of operation and maximum cleansing effectiveness.

2. Description of the Prior Art

Toothbrushes capable of simultaneously cleaning more than a single face of the user's teeth are known in the art. An example thereof is disclosed in U.S. Pat. No. 3,953,907, issued to Froidegaux, which teaches the use of a toothbrush having a bifurcated end of dual directly opposed brush heads. Another device capable of simultaneously cleansing more than one tooth face is disclosed in U.S. Pat. No. 4,972,542, issued to Moshos et al., which describes a toothbrush head which contains orthogonally oriented bristles, adapted to removably engage the head of a standard toothbrush. Still other configurations geared toward cleansing teeth with obliquely opposed confronting bristles are disclosed in U.S. Pat. Nos. 4,876,157, issued to Barman, and 4,449,266, issued to Northemann et al.

The aforementioned devices all suffer from similar inherent drawbacks. Because multiple brush heads are inserted into the limited space of the user's mouth, manipulation of the toothbrush is difficult, tending to negate the advantages conferred by employing multiple brush heads in the first place. This problem is exacerbated by the lack of adjustability designed into the brush to account for variations in the tooth profile and bite of the particular user. Finally, all of the hereinbefore described brushes lack a suitable grip handle to assist the user in easier and more precise manipulation of the brush heads.

Accordingly, the present invention is directed to overcoming the design deficiencies inherent in the foregoing prior art devices.

SUMMARY OF THE INVENTION

The present invention discloses a toothbrush for simultaneously brushing the top and side faces of the user's teeth. The brush is generally comprised of a pair of orthogonally confronting brush heads which are attached to an elongated body portion at one end thereof, and a grip handle attached to the body portion at its opposite end.

Each brush head comprises a plurality of segmented portions which are adjoined in flexible attachment by notching the periphery thereof at the attachment point. In this manner, each segment may flex and twist relative to an adjoining segment to conform the brush heads to the user's bite as they are translated against the user's teeth. Each segment has a plurality of bristles affixed thereto in the conventional manner. A pair of brush heads are disposed in orthogonal relationship, leaving a nominal distance therebetween to accommodate a row of teeth. One brush head is designated as "vertical" and the other as "horizontal." The vertical brush head is coaxial with the longitudinal axis and integral with the first end of the body portion. The horizontal brush head is orthogonally disposed relative to the vertical brush head and also integral with the first end of the body portion, extending either above or below and outward therefrom along a radius. The distinction between vertical and horizontal is purely for convenience of labeling, as either brush head may be used to clean either the top or sides of the teeth, depending upon the orientation of the handle.

The elongated body portion may be sized to accommodate different users, and made available in children and adult sizes. The body portion may include means for providing longitudinal bending and twisting thereof, to further assist in accommodation of the user's bite. This may be accomplished either by employing a resilient thermoplastic material, or by providing a plurality of closely adjoined segmented portions to reduce the relative crossectional area of the body portion.

At the second end of the body portion, an integral grip handle is provided to aid the user in grasping the brush to facilitate better maneuverability and control of the brush heads in the user's mouth. The handle is wider than the body portion, and may include a plurality of peripheral surface deformations to accommodate the user's fingers for comfortable gripping.

In accordance with the foregoing, it is an object of the present invention to provide a toothbrush with orthogonal brush heads for simultaneously cleaning more than one face of the user's teeth with each stroke.

It is another object of the instant invention to provide a toothbrush with inherent adjustability and versatility which conforms to the bite of the user.

It is yet another object of the invention to provide a toothbrush which maximizes cleansing efficiency, comfort, and ease of operation.

In accordance with these and other objects which will become apparent hereinafter, the instant invention will now be described with particular reference to the accompanying drawings.

BRIEF DESCRIPTION OF THE DRAWINGS

FIG. 1 is an isometric view of the toothbrush.

DESCRIPTION OF THE PREFERRED EMBODIMENTS

With regard to the single view in the drawing, there is depicted a toothbrush generally denoted by the reference numeral 10, generally comprised of a vertical and horizontal brush head 12 and 14, respectively, elongated body portion 16, and handle 18.

Brush heads 12 and 14 each comprise a plurality of segmented portions which are adjoined in flexible attachment by notching the periphery thereof at the attachment points generally characterized by the reference letter "N." Each segment has a bundle of bristles **20*a* and 20*b*, respectively, affixed thereto in accordance with conventional toothbrush construction. This permits each segment to independently flex and twist relative to an adjoining segment to better conform brush heads 12 and 14 to the particular user's bite. Brush head 12 is designated "vertical" and brush head 14 "horizontal," for purposes of identification only, as the orientation of the toothbrush 10 may easily changed within the user's mouth by simply rotating handle 18. Brush head 12 is unitarily formed in first end 22 of body portion 16 and is disposed coaxially therewith. Brush head 14 is also unitarily formed in first end 22 of body portion 16, and is oriented such that its set of bristles are orthogonally disposed relative to the bristles on brush head 12. Brush head 14 extends from body portion 16 along partially curved section 24, along a profile suitable to place bristle bundles 20***a* and 20*b* at an optimal distance therebetween to facilitate simultaneously abutting two faces of a row of teeth.

Body portion 16 is elongated to a dimension which provides the user with a comfortable holding position when grasping handle 18 and inserting brush heads 12 and 14 fully into the user's mouth. Conventional adult toothbrushes are in the range of seven and one-half to seven and three-quarter inches in length. A plurality of closely adjoined peripheral serrations 26 may be incorporated to locally reduce the crossectional area of body portion 16 to allow longitudinal bending and twisting to further assist the user in conforming toothbrush 10 to his or her bite. In lieu of, or in addition to serrations 26, body portion 16 may be fabricated from a thermoplastic having resilient properties that facilitate bending and twisting thereof.

Disposed at the second end 28 of body portion 16, is a unitarily formed grip handle 18 to facilitate better grasping of toothbrush 10 which permits superior control and maneuverability of brush heads 12 and 14 during the cleansing process when in the user's mouth. Handle 18 has a plan form of substantially greater width than body portion 16, and may include a plurality of peripheral surface undulations 30 to accommodate the fingers of the user for comfortable gripping. Thru-hole 32 in handle 18 may be provided to permit hanging storage of toothbrush 10.

The present invention has been disclosed in what is considered to be the most practical and preferred embodiment. It is recognized, however, that departures may be made therefrom and that obvious modifications will occur to a person skilled in the art.

What is claimed is:

1. A toothbrush for simultaneously brushing the top and side faces of the user's teeth, comprising:

a first brush head having a plurality of flexibly adjoined segmented portions, each of said segmented portions having a plurality of bristles rigidly attached thereto and spaced to include a gap therebetween, and extending outward therefrom;

a second brush head having a plurality of flexibly adjoined segmented portions, each of said segmented portions having a plurality of bristles rigidly attached thereto, and extending outward therefrom, bristles of said second brush head positioned orthogonally and at a spaced relationship relative to said bristles of said first brush head;

an elongated body portion of narrow plan form width having first and second ends along a body axis, said first end being integral and axially aligned with said first brush head and further wherein said body portion includes at least three ridges extending in and transverse to the length of said elongated body portion for allowing said body portion to bend and twist longitudinally in relation to said first and second brush heads; and a handle integral with said body portion at said second end thereof, whereby said first and second brush heads may be strategically positioned against said user's teeth to simultaneously brush said top and side faces thereof, wherein said flexibly adjoined segmented portions may bend and twist relatively therebetween to conform to said user's tooth profile and bite.

2. The toothbrush recited in claim 1, wherein said handle comprises an elongated member having a plan form of a greater transverse dimension than said body portion width, said handle elongated member further having a plurality of peripheral edge undulations to facilitate grasping by said user.

3. The toothbrush recited in claim 1, wherein a flat surface of the ends of said elongated body portion defines a first plane and a surface of said bristles on said first brush head define a second plane, whereby said first and said second planes are oriented along separate planes so as said first brush head bristles faces away from the surface of said elongated body portion.

4. A toothbrush for simultaneously brushing the top and side faces of the user's teeth, comprising:

a first brush head having a plurality of flexibly adjoined segmented portions, each of said segmented portions having a plurality of bristles rigidly attached thereto and spaced to include a gap therebetween and extending outward therefrom;

a second brush head having a plurality of flexibly adjoined segmented portions, each of said segmented portions having a plurality of bristles rigidly attached thereto and spaced to include a gap therebetween and extending outward therefrom, said bristles of said second brush head positioned orthogonally and at a spaced relationship relative to said bristles of said first brush head;

an elongated body portion having first and second ends along a body axis and said body portion including at least three ridges extending in and transverse to the length of said elongated body portion for allowing said body portion to bend and twist longitudinally in relation to said first and second brush heads, said first end being axially aligned with said brush head and integral with said first and second brush heads; and a handle integral with said body portion at said second end thereof, said handle comprising a elongated member having a plan form of a greater transverse dimension than said body portion width, said handle further having a plurality of peripheral edge finger sized undulations on one side thereof and a thumb undulation on the opposite side to facilitate grasping by said user, whereby said first and second brush heads may be strategically positioned against said user's teeth to simultaneously brush said top and side faces thereof, wherein said flexibly adjoined segmented portions may bend and twist relatively therebetween to conform to said user's tooth profile and bite.

5. The toothbrush recited in claim 4, wherein a flat surface of the ends of said elongated body portion defines a first plane and a surface of said bristles on said first brush head define a second plane, whereby said first and said second planes are oriented along separate planes so as said first brush head bristles faces away from the surface of said elongated body portion.

* * * * *